US008406647B2

(12) United States Patent
Shinshi et al.

(10) Patent No.: US 8,406,647 B2
(45) Date of Patent: Mar. 26, 2013

(54) FIXING DEVICE INCLUDING A RADIATION MEMBER TO COOL A FIXING MEMBER AND A HEAT CONDUCTIVE MEMBER

(75) Inventors: Akira Shinshi, Machida (JP); Yoshiki Yamaguchi, Sagamihara (JP); Kenichi Hasegawa, Atsugi (JP); Masaaki Yoshikawa, Tokyo (JP); Hiroshi Yoshinaga, Ichikawa (JP); Kenji Ishii, Kawasaki (JP); Tetuso Tokuda, Kawasaki (JP); Ippei Fujimoto, Ebina (JP); Naoki Iwaya, Chofu (JP); Yutaka Ikebuchi, Chigasaki (JP); Shuntaroh Tamaki, Kawasaki (JP); Takahiro Imada, Yokohama (JP); Takamasa Hase, Kawasaki (JP); Toshihiko Shimokawa, Zama (JP)

(73) Assignee: Ricoh Company, Limited, Tokyo (JP)

( * ) Notice: Subject to any disclaimer, the term of this patent is extended or adjusted under 35 U.S.C. 154(b) by 338 days.

(21) Appl. No.: 12/878,557

(22) Filed: Sep. 9, 2010

(65) Prior Publication Data

US 2011/0058863 A1 Mar. 10, 2011

(30) Foreign Application Priority Data

Sep. 10, 2009 (JP) ..... 2009-209177

(51) Int. Cl.
*G03G 15/20* (2006.01)

(52) U.S. Cl. ..... 399/69; 399/329

(58) Field of Classification Search ..... 399/69, 399/70, 92, 94, 320, 328, 329
See application file for complete search history.

(56) References Cited

U.S. PATENT DOCUMENTS

| | | | |
|---|---|---|---|
| 5,839,032 | A | 11/1998 | Yasui et al. |
| 6,112,047 | A | 8/2000 | Kato et al. |
| 6,131,009 | A | 10/2000 | Hasegawa |
| 6,134,418 | A | 10/2000 | Kato et al. |
| 6,263,185 | B1 | 7/2001 | Kato et al. |
| 6,496,666 | B2 | 12/2002 | Hayashi et al. |
| 6,591,081 | B2 | 7/2003 | Hasegawa |
| 6,628,916 | B2 | 9/2003 | Yasui et al. |
| 6,636,709 | B2 | 10/2003 | Furukawa et al. |
| 6,778,790 | B2 | 8/2004 | Yoshinaga et al. |
| 6,778,804 | B2 | 8/2004 | Yoshinaga et al. |

(Continued)

FOREIGN PATENT DOCUMENTS

| | | |
|---|---|---|
| JP | 10-213984 | 8/1998 |
| JP | 2884714 | 2/1999 |

(Continued)

*Primary Examiner* — William J Royer
(74) *Attorney, Agent, or Firm* — Oblon, Spivak, McClelland, Maier & Neustadt, L.L.P.

(57) ABSTRACT

A fixing device includes an endless, flexible fixing member, a heat conductive member, a heater, a pressing member, a nip formation member, and a radiation member. The endless, flexible fixing member is formed into a loop. The heat conductive member is disposed within the loop formed by the fixing member to conduct heat to the fixing member. The heater is disposed near the heat conductive member to heat the heat conductive member. The pressing member is rotatably pressed against the fixing member to form a fixing nip between the fixing member and the pressing member. A recording medium is conveyed through the fixing nip. The radiation member is detachably pressable against an outer circumference of the fixing member to contact the fixing member with the heat conductive member to cool the fixing member and the heat conductive member.

8 Claims, 6 Drawing Sheets

U.S. PATENT DOCUMENTS

| | | | | |
|---|---|---|---|---|
| 6,785,505 | B2 | 8/2004 | Yasui et al. | |
| 6,813,464 | B2 | 11/2004 | Amita et al. | |
| 6,881,927 | B2 | 4/2005 | Yoshinaga et al. | |
| 6,882,820 | B2 | 4/2005 | Shinshi et al. | |
| 6,892,044 | B2 | 5/2005 | Yasui et al. | |
| 6,937,827 | B2 | 8/2005 | Katoh et al. | |
| 7,022,944 | B2 | 4/2006 | Yoshinaga et al. | |
| 7,070,182 | B2 | 7/2006 | Hasegawa | |
| 7,127,204 | B2 | 10/2006 | Satoh et al. | |
| 7,151,907 | B2 | 12/2006 | Yoshinaga | |
| 7,239,838 | B2 | 7/2007 | Sato et al. | |
| 7,242,897 | B2 | 7/2007 | Satoh et al. | |
| 7,313,353 | B2 | 12/2007 | Satoh et al. | |
| 7,330,682 | B2 | 2/2008 | Shinshi | |
| 7,379,698 | B2 | 5/2008 | Yoshinaga | |
| 7,398,028 | B2 * | 7/2008 | Nakagaki | 399/320 |
| 7,437,111 | B2 | 10/2008 | Yamada et al. | |
| 7,454,151 | B2 | 11/2008 | Satoh et al. | |
| 7,466,949 | B2 | 12/2008 | Satoh et al. | |
| 7,509,085 | B2 | 3/2009 | Yoshinaga et al. | |
| 7,515,850 | B2 | 4/2009 | Hasegawa | |
| 7,546,049 | B2 | 6/2009 | Ehara et al. | |
| 7,570,910 | B2 | 8/2009 | Ishii | |
| 7,593,680 | B2 | 9/2009 | Shinshi | |
| 7,630,652 | B2 | 12/2009 | Hasegawa | |
| 7,702,271 | B2 | 4/2010 | Yamada et al. | |
| 7,742,714 | B2 | 6/2010 | Shinshi et al. | |
| 7,783,240 | B2 | 8/2010 | Ito et al. | |
| 8,041,279 | B2 * | 10/2011 | Kladias et al. | 399/329 |
| 8,068,758 | B2 * | 11/2011 | Kaji | 399/94 |
| 8,213,827 | B2 * | 7/2012 | Shinshi et al. | 399/92 |
| 8,224,202 | B2 * | 7/2012 | Urano | 399/69 |
| 2006/0029411 | A1 | 2/2006 | Ishii et al. | |
| 2006/0257183 | A1 | 11/2006 | Ehara et al. | |
| 2007/0003334 | A1 | 1/2007 | Shinshi et al. | |
| 2007/0014600 | A1 | 1/2007 | Ishii et al. | |
| 2007/0059071 | A1 | 3/2007 | Shinshi et al. | |
| 2007/0292175 | A1 | 12/2007 | Shinshi | |
| 2008/0063443 | A1 | 3/2008 | Yoshinaga et al. | |
| 2008/0112739 | A1 | 5/2008 | Shinshi | |
| 2008/0175633 | A1 | 7/2008 | Shinshi | |
| 2008/0219730 | A1 | 9/2008 | Shinshi | |
| 2008/0226326 | A1 | 9/2008 | Seo et al. | |
| 2008/0232873 | A1 | 9/2008 | Ueno et al. | |
| 2008/0253788 | A1 | 10/2008 | Shinshi | |
| 2008/0253789 | A1 | 10/2008 | Yoshinaga et al. | |
| 2008/0298862 | A1 | 12/2008 | Shinshi | |
| 2008/0317532 | A1 | 12/2008 | Ehara et al. | |
| 2009/0003867 | A1 | 1/2009 | Fujimoto | |
| 2009/0067902 | A1 | 3/2009 | Yoshinaga et al. | |
| 2009/0123201 | A1 | 5/2009 | Ehara et al. | |
| 2009/0123202 | A1 | 5/2009 | Yoshinaga et al. | |
| 2009/0148204 | A1 | 6/2009 | Yoshinaga et al. | |
| 2009/0148205 | A1 | 6/2009 | Seo et al. | |
| 2009/0169232 | A1 | 7/2009 | Kunii et al. | |
| 2009/0245865 | A1 | 10/2009 | Shinshi et al. | |
| 2009/0245897 | A1 | 10/2009 | Seo et al. | |
| 2009/0297197 | A1 | 12/2009 | Hase | |
| 2009/0311016 | A1 | 12/2009 | Shinshi | |
| 2010/0061753 | A1 | 3/2010 | Hase | |
| 2010/0074667 | A1 | 3/2010 | Ehara et al. | |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |

FOREIGN PATENT DOCUMENTS

| | | |
|---|---|---|
| JP | 3298354 | 4/2002 |
| JP | 4136436 | 6/2008 |
| JP | 2009-3410 | 1/2009 |

* cited by examiner

FIXING DEVICE INCLUDING A RADIATION MEMBER TO COOL A FIXING MEMBER AND A HEAT CONDUCTIVE MEMBER

CROSS-REFERENCE TO RELATED APPLICATIONS

The present patent application claims priority pursuant to 35 U.S.C. §119 from Japanese Patent Application No. 2009-209177, filed on Sep. 10, 2009 in the Japan Patent Office, which is incorporated herein by reference in its entirety.

BACKGROUND OF THE DISCLOSURE

1. Field of the Disclosure

Exemplary embodiments of the present disclosure relate to a fixing device and an image forming apparatus including the fixing device, and more specifically, to a fixing device that applies heat and pressure to a recording medium at a nip formed between a fixing member and a pressing member to fix an image on the recording medium, and an image forming apparatus including the fixing device.

2. Description of the Background

As one type of image forming apparatus, electrophotographic image forming apparatuses are widely known. In an image formation process executed by an electrophotographic image forming apparatus, for example, a charger uniformly charges a surface of an image carrier (e.g., photoconductor drum); an optical writing unit directs a light beam onto the charged surface of the image carrier to form an electrostatic latent image on the image carrier according to image data; a development device supplies toner to the electrostatic latent image formed on the image carrier to make the electrostatic latent image visible as a toner image; the toner image is either directly transferred from the image carrier onto a recording medium or indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device may be either a belt-type fixing device or a film-type fixing device. FIG. 1 shows a schematic configuration of a conventional belt-type fixing device. In FIG. 1, the belt-type fixing device includes a heating roller 202, a fixing roller 203, a fixing belt 204, and a pressing roller 205. The heating roller 202 includes a heater 201. The fixing roller 203 includes a rubber layer on its surface. The fixing belt 204 is stretched between and wound around the heating roller 202 and the fixing roller 203. The pressing roller 205 presses against the fixing roller 203 via the fixing belt 204 to form a fixing nip N through which a recording medium P passes.

To fix a toner image onto a sheet of recording medium P, the recording medium P is conveyed to the fixing nip N between the fixing belt 204 and the pressing roller 205. When the recording medium P passes through the fixing nip N, heat and pressure are applied to the toner image on the recording medium P to fix the toner image on the recording medium P.

By contrast, FIG. 2 shows a schematic configuration of a conventional film-type fixing device. As described in JP-H04-044075-A, typically, a ceramic heater 211 and a pressing roller 212 together sandwich a heat-resistant film 213, which is the functional equivalent of the fixing belt 204 described above, to form a fixing nip N. A recording sheet is fed to the fixing nip N between the heat-resistant film 213 and the pressing roller 212. Then, the recording sheet is sandwiched by the heat-resistant film 213 and the pressing roller 212 to be conveyed together with the heat-resistant film 213. At the fixing nip N, heat of the ceramic heater 211 is applied to the recording sheet with pressure via the heat-resistant film 213 to fix a toner image on the recording sheet.

The film-type fixing device may be an on-demand type fixing device, including a ceramic heater and a film member of low heat capacity. In an image forming apparatus including such a fixing device, the ceramic heater is turned on only during image formation to generate heat at a certain fixing temperature to shorten a waiting time required to reach a state ready for image formation from activation of the image forming apparatus, thereby reducing power consumption in a standby mode of operation.

Further, a conventional pressing-belt-type fixing device like that described in JP-H08-262903-A includes a heat fixing roller, an endless belt, and a pressing pad. The heat fixing roller is rotatable and has an elastically deformable surface. The endless belt travels in contact with the heat fixing roller. The pressing pad is fixedly mounted inside a loop formed by the endless belt and presses the endless belt against the heat fixing roller to form a belt nip between the endless belt and the heat fixing roller through which a recording medium passes.

According to the pressing-belt-type fixing device described above, the pressure of the pressing pad against the endless belt elastically deforms the surface of the heat fixing roller and enlarges a contact area of the heat fixing roller and the recording medium to enhance heat conduction efficiency, reduce energy consumption, and achieve a more compact design.

However, for example, in the above-described film-type fixing device described in JP-H04-044075-A, there is room for improvement in durability and temperature stability of the fixing belt.

For example, the fixing belt is made of heat-resistant film and is abrasion-resistant. However, since the fixing belt slides over the ceramic heater as the fixing belt rotates, the fixing belt tends to get worn out when driven for an extended period of time. Accordingly, rotation of the fixing belt may become unsteady and/or the driving torque required by the fixing device may increase, neither of which is desirable. Consequently, the recording medium may slip on the fixing belt, causing displacement of a resultant image. Alternatively, a driving gear may be subjected to increased stress, causing damage to the gear.

Further, in the film-type fixing device, the fixing belt is heated locally, that is, only at the fixing nip. As a result, the temperature of the fixing belt is at its lowest when the fixing belt in rotation returns to an entrance of the fixing nip, causing faulty fixing, particularly at high-speed rotation.

To reduce the friction between the fixing belt and the ceramic heater or other stationary members, for example, JP-H08-262903-A describes a fixing device using a fiberglass sheet (PTFE-impregnated glass cloth) impregnated with polytetrafluoroethylene (PTFE) as a low-friction sheet (a sheet-shaped sliding member) as a surface layer of the pressing pad.

However, in the above-described pressing-belt-type fixing device, a large heat capacity of the fixing roller may increase the time required for raising the temperature of the fixing roller to the required level, thereby extending the warm-up time.

Hence, to deal with such a challenge, the inventors of the present disclosure proposed a fixing device in JP-2009-03410-A.

For the fixing device, differing from the above-described film-fixing-type or pressing-belt-type fixing device, substantially the whole area of the inner face of the fixing belt is guided by a pipe-shaped metal member disposed adjacent to the fixing belt, within a loop into which the fixing belt is formed. The fixing belt is heated via the pipe-shaped metal member heated by a heater.

However, for the fixing device, there is a challenge that the pipe-shaped metal member to conduct heat to the fixing belt is difficult to cool.

Typically, when a user deals with a paper jam or a service person replaces components, it may take some time for the fixing device to cool naturally. Hence, in a conventional type of fixing device like that described in JP-4136436-B, a fan for cooling the fixing device is used to reduce such waiting time.

However, in the fixing device like that described in JP-2009-03410-A, when the fixing belt is stopped, there is a slight clearance between the fixing belt and the pipe-shaped metal member. Consequently, the heat conductivity between the fixing belt and the pipe-shaped metal member is relatively low, and even if the fixing belt is air-cooled from its outer side, the pipe-shaped metal member disposed inside the loop formed by the fixing belt is not effectively cooled.

In other words, even if the fixing belt is air-cooled below a threshold temperature as determined by a temperature sensor, the pipe-shaped metal member inside the loop formed by the fixing belt remains hot. Consequently, if a user touches the fixing belt, the fixing belt contacts the pipe-shaped metal member and heat of the pipe-shaped metal member is rapidly conducted to the fixing belt, making the user feel hot.

Further, for the fixing device like that described in JP-2009-03410-A, a pipe-shaped heating member is made of a thin sheet of metal to reduce the heat capacity of the pipe-shaped heating member and the warm-up time. However, since the heat capacity is relatively low, air-cooling like that described above may cause uneven heat distribution in the pipe-shaped heating member.

At this time, some portions of the fixing belt are relatively hot and other portions are relatively cool. If such temperature deviation occurs in the axial direction of the fixing belt, when a subsequent image formation is performed after cooling, this temperature deviation may affect fixing performance at the fixing nip, resulting in a faulty image.

SUMMARY

In at least one exemplary embodiment, there is provided an improved fixing device including an endless, flexible fixing member, a heat conductive member, a heater, a pressing member, a nip formation member, and a radiation member. The endless, flexible fixing member is formed into a loop. The heat conductive member is disposed within the loop formed by the fixing member to conduct heat to the fixing member. The heater is disposed near the heat conductive member to heat the heat conductive member. The pressing member is rotatably pressed against the fixing member to form a fixing nip between the fixing member and the pressing member. A recording medium is conveyed through the fixing nip. The radiation member is detachably pressable against an outer circumference of the fixing member to contact the fixing member with the heat conductive member to cool the fixing member and the heat conductive member.

In at least one exemplary embodiment, there is provided an improved image forming apparatus including an image forming device that forms an image on a recording medium and a fixing device that fixes the image, formed by the image forming device, on the recording medium. The fixing device includes an endless, flexible fixing member, a heat conductive member, a heater, a pressing member, a nip formation member, and a radiation member. The endless, flexible fixing member is formed into a loop. The heat conductive member is disposed within the loop formed by the fixing member to conduct heat to the fixing member. The heater is disposed near the heat conductive member to heat the heat conductive member. The pressing member is rotatably pressed against the fixing member to form a fixing nip between the fixing member and the pressing member. The recording medium is conveyed through the fixing nip. The radiation member is detachably pressable against an outer circumference of the fixing member to contact the fixing member with the heat conductive member to cool the fixing member and the heat conductive member.

BRIEF DESCRIPTION OF THE DRAWINGS

Additional aspects, features, and advantages will be readily ascertained as the same becomes better understood by reference to the following detailed description when considered in connection with the accompanying drawings, wherein.

Figure 1:
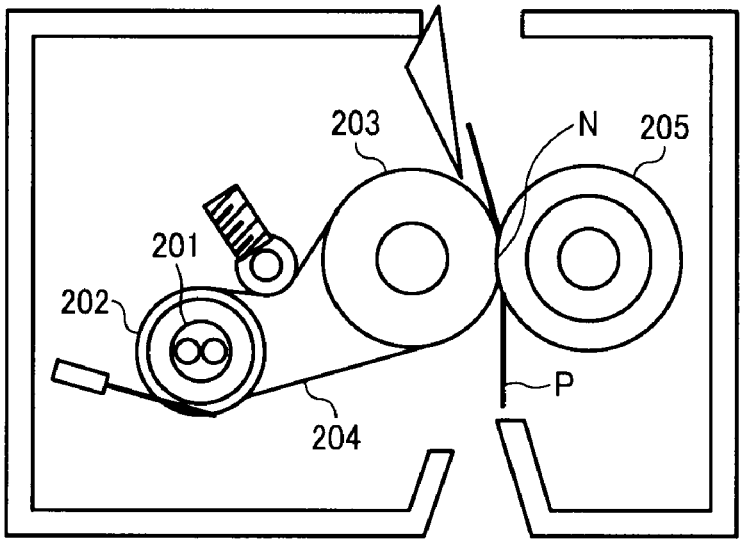
FIG. 1 RELATED ART
FIG. 1 shows a schematic configuration of a conventional type of fixing device.
Figure 2:
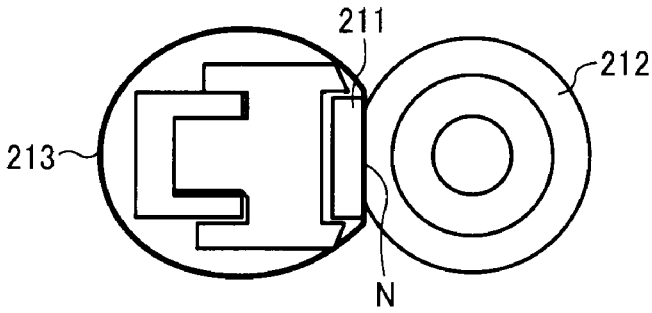
FIG. 2 RELATED ART
FIG. 2 shows a schematic configuration of another conventional type of fixing device.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and not all of the components or elements described in the exemplary embodiments of this disclosure are necessarily indispensable to the present invention.

It is to be noted that, in the description below, suffixes Y, M, C, and K attached to reference numerals indicate only that components indicated thereby are used for forming yellow, magenta, cyan, and black images, respectively, and hereinafter may be omitted when color discrimination is not necessary.

Referring now to the drawings, wherein like reference numerals designate identical or corresponding parts throughout the several views, in particular to FIG. 3, an image forming apparatus 1 according to an exemplary embodiment of the present disclosure is described below.

Figure 3:
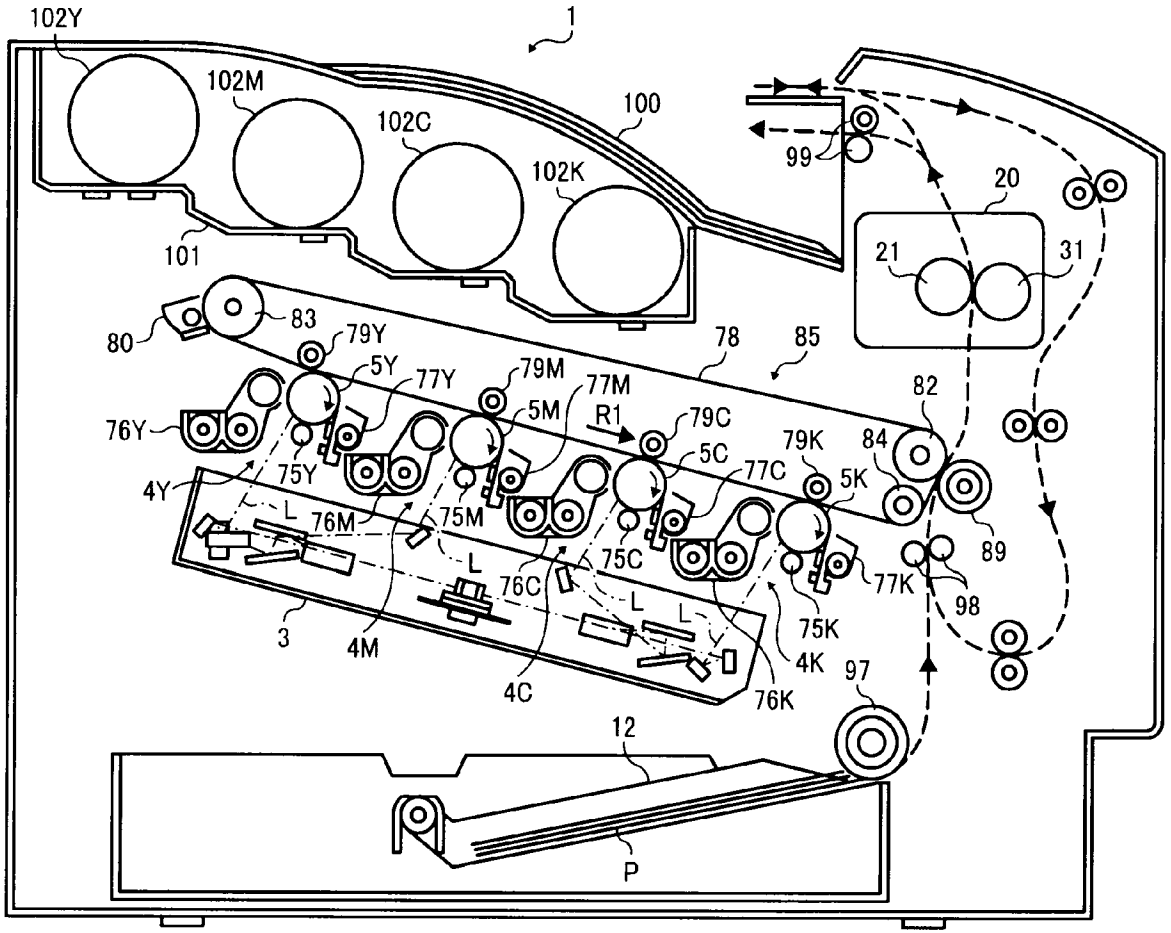
FIG. 3 shows a schematic configuration of an image forming apparatus according to an exemplary embodiment of the present disclosure.

FIG. 3 is a schematic elevation view illustrating a configuration of the image forming apparatus 1 according to exemplary embodiments of the present disclosure.

In FIG. 3, the image forming apparatus 1 is illustrated as a tandem color printer for forming a color image on a recording medium P. However, it is to be noted that the image forming apparatus 1 may be a copier, a facsimile machine, a printer, a multifunctional peripheral having at least two of copying, printing, scanning, plotter, facsimile capabilities, and the like.

As illustrated in FIG. 3, the image forming apparatus 1 includes an exposure device 3, image forming devices 4Y, 4M, 4C, and 4K, a paper tray 12, a fixing device 20, an intermediate transfer unit 85, a second transfer roller 89, a feed roller 97, a registration roller pair 98, an output roller pair 99, a stack portion 100, and a toner bottle holder 101.

The image forming devices 4Y, 4M, 4C, and 4K include photoconductive drums 5Y, 5M, 5C, and 5K, chargers 75Y, 75M, 75C, and 75K, development devices 76Y, 76M, 76C, and 76K, and cleaners 77Y, 77M, 77C, and 77K, respectively.

The fixing device 20 includes a fixing belt 21 and a pressing roller 31.

The intermediate transfer unit 85 includes an intermediate transfer belt 78, first transfer bias rollers 79Y, 79M, 79C, and 79K, an intermediate transfer cleaner 80, a second transfer backup roller 82, a cleaning backup roller 83, and a tension roller 84.

The toner bottle holder 101 includes toner bottles 102Y, 102M, 102C, and 102K. The toner bottle holder 101 is provided in an upper portion of the image forming apparatus 1. The four toner bottles 102Y, 102M, 102C, and 102K contain yellow, magenta, cyan, and black toners, respectively, and are detachably attached to the toner bottle holder 101 so that the toner bottles 102Y, 102M, 102C, and 102K are replaced with new ones, respectively.

The intermediate transfer unit 85 is provided below the toner bottle holder 101. The image forming devices 4Y, 4M, 4C, and 4K are arranged opposite the intermediate transfer belt 78 of the intermediate transfer unit 85, and form yellow, magenta, cyan, and black toner images, respectively.

In the image forming devices 4Y, 4M, 4C, and 4K, the chargers 75Y, 75M, 75C, and 75K, the development devices 76Y, 76M, 76C, and 76K, the cleaners 77Y, 77M, 77C, and 77K, and dischargers surround the photoconductive drums 5Y, 5M, 5C, and 5K, respectively.

Image forming processes including a charging process, an exposure process, a development process, a first transfer process, and a cleaning process are performed on the rotating photoconductive drums 5Y, 5M, 5C, and 5K to form yellow, magenta, cyan, and black toner images on the photoconductive drums 5Y, 5M, 5C, and 5K, respectively.

The following describes the image forming processes performed on the photoconductive drums 5Y, 5M, 5C, and 5K.

A driving motor drives and rotates the photoconductive drums 5Y, 5M, 5C, and 5K clockwise in FIG. 3. In the charging process, the chargers 75Y, 75M, 75C, and 75K are disposed opposite the photoconductive drums 5Y, 5M, 5C, and 5K, respectively, and uniformly charge surfaces of the photoconductive drums 5Y, 5M, 5C, and 5K.

In the exposure process, the exposure device 3 emits laser beams L onto the charged surfaces of the photoconductive drums 5Y, 5M, 5C, and 5K to expose the charged surfaces of the photoconductive drums 5Y, 5M, 5C, and 5K, respectively, so as to form thereon electrostatic latent images corresponding to yellow, magenta, cyan, and black colors, respectively.

In the development process, the development devices 76Y, 76M, 76C, and 76K render the electrostatic latent images formed on the surfaces of the photoconductive drums 5Y, 5M, 5C, and 5K visible as yellow, magenta, cyan, and black toner images, respectively.

In the first transfer process, the first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78. Thus, a color toner image is formed on the intermediate transfer belt 78.

After the transfer of the yellow, magenta, cyan, and black toner images, the surfaces of the photoconductive drums 5Y, 5M, 5C, and 5K from which the yellow, magenta, cyan, and black toner images are transferred reach positions at which the cleaners 77Y, 77M, 77C, and 77K are disposed opposite the photoconductive drums 5Y, 5M, 5C, and 5K, respectively. In the cleaning process, cleaning blades included in the cleaners 77Y, 77M, 77C, and 77K mechanically collect residual toner remaining on the surfaces of the photoconductive drums 5Y, 5M, 5C, and 5K from the photoconductive drums 5Y, 5M, 5C, and 5K, respectively. Thereafter, dischargers remove residual potential on the surfaces of the photoconductive drums 5Y, 5M, 5C, and 5K, respectively, thus completing a single sequence of image forming processes performed on the photoconductive drums 5Y, 5M, 5C, and 5K.

The following describes a series of transfer processes performed on the intermediate transfer belt 78.

The intermediate transfer unit 85 includes the endless, intermediate transfer belt 78, the four first transfer bias rollers 79Y, 79M, 79C, and 79K, the second transfer backup roller 82, the cleaning backup roller 83, the tension roller 84, and the intermediate transfer cleaner 80.

The intermediate transfer belt 78 is supported by and stretched over the second transfer backup roller 82, the cleaning backup roller 83, and the tension roller 84. The second transfer backup roller 82 drives and rotates the intermediate transfer belt 78 in a direction R1.

The first transfer bias rollers 79Y, 79M, 79C, and 79K and the photoconductive drums 5Y, 5M, 5C, and 5K sandwich the intermediate transfer belt 78 to form first transfer nips, respectively. The first transfer bias rollers 79Y, 79M, 79C, and 79K are applied with a transfer bias having a polarity opposite to a polarity of toner forming the yellow, magenta, cyan, and black toner images on the photoconductive drums 5Y, 5M, 5C, and 5K, respectively.

As the intermediate transfer belt 78 moves in the direction R1 and passes through the first transfer nips formed between the intermediate transfer belt 78 and the photoconductive drums 5Y, 5M, 5C, and 5K successively, the yellow, magenta, cyan, and black toner images formed on the photoconductive drums 5Y, 5M, 5C, and 5K, respectively, are transferred and superimposed onto the intermediate transfer belt 78 at the first transfer nips formed between the photoconductive drums 5Y, 5M, 5C, and 5K and the intermediate transfer belt 78. Thus, a color toner image is formed on the intermediate transfer belt 78.

After the first transfer process, an outer circumferential surface of the intermediate transfer belt 78 bearing the color toner image reaches a position at which the second transfer roller 89 is disposed opposite the intermediate transfer belt 78. At this position, the second transfer roller 89 and the second transfer backup roller 82 sandwich the intermediate transfer belt 78 to form the second transfer nip between the second transfer roller 89 and the intermediate transfer belt 78. At the second transfer nip, the second transfer roller 89 transfers the color toner image formed on the intermediate transfer belt 78 onto the recording medium P fed by the registration roller pair 98 in a second transfer process.

After the second transfer process, when the outer circumferential surface of the intermediate transfer belt 78 reaches a position at which the intermediate transfer cleaner 80 is disposed opposite the intermediate transfer belt 78, the intermediate transfer cleaner 80 collects residual toner from the intermediate transfer belt 78, thus completing a single sequence of transfer processes performed on the intermediate transfer belt 78.

In this regard, the recording medium P is fed from the paper tray 12 to the second transfer nipping position via the feed roller 97 and the registration roller pair 98.

The paper tray 12 is provided in a lower portion of the image forming apparatus 1, and loads a plurality of recording media P (e.g., transfer sheets).

The feed roller 97 rotates counterclockwise in FIG. 3 to feed an uppermost recording medium P of the plurality of recording media P loaded on the paper tray 12 toward the registration roller pair 98.

The registration roller pair 98, which stops rotating temporarily, stops the uppermost recording medium P fed by the feed roller 97. For example, a roller nip of the registration roller pair 98 contacts and stops a leading edge of the recording medium P temporarily.

The registration roller pair 98 resumes rotating to feed the recording medium P to the second transfer nip, formed between the second transfer roller 89 and the intermediate transfer belt 78, as the color toner image formed on the intermediate transfer belt 78 reaches the second transfer nip. Thus, the color toner image is transferred on the recording medium P.

The recording medium P bearing the color toner image is sent to the fixing device 20. In the fixing device 20, the fixing belt 21 and the pressing roller 31 apply heat and pressure to the recording medium P to fix the color toner image on the recording medium P.

Thereafter, the fixing device 20 feeds the recording medium P bearing the fixed color toner image toward the output roller pair 99. The output roller pair 99 discharges the recording medium P to an outside of the image forming apparatus 1, that is, the stack portion 100. Thus, the recording media P discharged by the output roller pair 99 are stacked on the stack portion 100.

Figure 4:
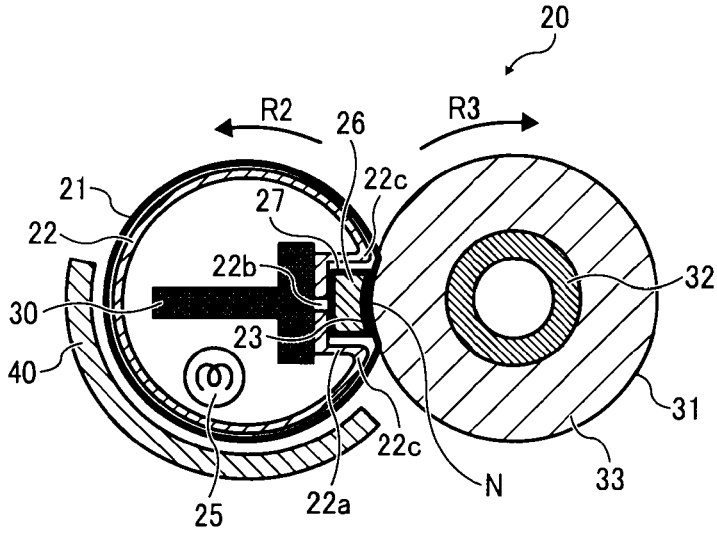
FIG. 4 is a cross-sectional elevation view illustrating a fixing device according to a first exemplary embodiment.

FIG. 4 is a cross-sectional elevation view illustrating the fixing device 20 according to a first exemplary embodiment of the present disclosure.

In FIG. 4, the fixing device 20 includes the fixing belt 21, a stationary heat conductive member 22, a halogen heater 25, a thermistor, a pressing roller 31, and a radiation member 40. The fixing belt 21 is an endless belt member serving as a fixing member. The heat conductive member 22 has a pipe shape and is disposed inside a loop formed by the fixing belt 21. The halogen heater 25 is a heating member, and the thermistor is a temperature sensor in contact with the fixing belt 21 to detect a surface temperature of the fixing belt 21. The pressing roller 31 is a pressing member disposed in contact with the fixing belt 21 to form a fixing nip N therewith through which the recording medium passes. The radiation member 40 has a circular cross section and is disposed facing a portion of an outer circumferential face of the fixing belt 21.

The heat conductive member 22 includes a recessed portion 22*a* opposite the fixing nip N. At the recessed portion 22*a* are disposed a nip formation member 26, a lubrication sheet 23 of, e.g., a mesh type, interposed between the fixing belt 21 and the nip formation member 26, and a heat insulator 27 between the nip formation member 26 and a bottom of the recessed portion 22*a*.

The nip formation member 26 is formed of an elastic material, such as silicone rubber or fluorocarbon rubber. An inner surface of the fixing belt 21 indirectly slides over the nip formation member 26 via the lubrication sheet 23. Alternatively, the inner surface of the fixing belt 21 may directly slide over the nip formation member 26.

It is to be noted that the portion of the heat conductive member 22 where the recessed portion 22*a* is located is not limited to the recessed shape described above and may be a flat shape or any other suitable shape. However, the recessed shape has the advantage of forcing the leading edge of the recording medium P toward the pressing roller 31 as the recording medium P exits the fixing nip N, which allows the recording medium P to more easily separate from the fixing belt 21, thereby preventing sheet jam.

In the present embodiment, the pressing roller 31 is a hollow metal roller having a silicone rubber layer. A releasing layer, such as a perfluoroalkoxy (PFA) resin layer or a polytetrafluoroethylene (PTFE) resin layer, is formed on an outer surface of the pressing roller 31 to obtain good releasing property.

The pressing roller 31 is rotated by a driving force transmitted via a gear train from a driving source, such as a motor, disposed in the image forming apparatus 1. Further, the pressing roller 31 is pressed against the fixing belt 21 by a spring or other, similar urging member. As a result, the rubber layer of the pressing roller 31 is squashed against the fixing belt 21 and the nip formation member 26 and deformed to form a certain width of the fixing nip N.

It is to be noted that the pressing roller 31 may be a solid roller. However, a hollow roller is preferable in that the heat capacity is relatively small. In addition, the pressing roller 31 may include a heat source such as a halogen heater.

The silicone rubber layer of the pressing roller 31 may be solid rubber. Alternatively, if a heat source, such as a heater, is not provided in the pressing roller 31, the silicone rubber layer may be made of sponge rubber. Sponge rubber is preferable in that the insulation performance is relatively high and thus less of the heat of the fixing belt 21 is transmitted to the pressing roller 31.

The fixing belt 21 is an endless belt (or film) including nickel, stainless, or other metal or a polyimide resin or other resin. The fixing belt 21 has a releasing layer, such as a PFA resin layer or a PTFE resin layer, on its surface to prevent toner on the recording medium P from adhering to the fixing belt 21.

A silicone rubber layer or other elastic layer may be formed between the substrate of the fixing belt 21 and the surface PFA (or PTFE) resin layer. If the silicone rubber layer is not provided, the heat capacity of the fixing belt 21 is relatively small, enhancing the fixing performance. However, when an unfixed toner image is compressed by the surface of fixing belt 21, minute irregularities in the surface of the fixing belt 21 may be transferred to the toner image. To prevent such an occurrence, the silicone rubber layer may be formed with a thickness of, e.g., 100 um or more. Deformation of a silicone rubber layer of such a thickness can absorb such minute irregularities, preventing formation of an irregular toner image.

The heat conductive member 22 has a pipe shape and is a metal such as aluminum, iron, and/or stainless steel. The heat conductive member 22 according to the present exemplary embodiment has a diameter which is, e.g., approximately 1 mm smaller than a diameter of the fixing belt 21 when the fixing belt 21 is formed into a loop around the heat conductive member 22. In this regard, it is to be noted that the cross-sectional shape of the fixing belt 21, that is, the shape into which it is formed, is not limited to the circular shape and may for example be a rectangular shape.

The nip formation member 26 and the heat insulator 27 are installed in the recessed portion 22*a* of the heat conductive member 22. A substantially T-shaped holding unit 30 is provided inside the heat conductive member 22 to support the recessed portion 22*a*, the nip formation member 26, and the heat insulator 27.

In such a configuration, the holding unit 30 might be heated by, e.g., radiation heat of the halogen heater 25. In such a case, the surface of the holding unit 30 may be insulated or mirror-finished to prevent heating. Such a configuration can prevent wasteful heat energy consumption.

It is to be noted that the heat source to heat the heat conductive member 22 is not limited to the halogen heater 25 as illustrated in FIG. 4 and may be, e.g., an induction heater. Further, a resistance heater or a carbon heater may be employed.

In the fixing device 20 illustrated in FIG. 4, the fixing belt 21 is heated via the heat conductive member 22. Alternatively, the fixing belt 21 may be directly heated by a heat source.

The pressing roller 31 has a diameter of, for example, approximately 30 mm. In the pressing roller 31, an elastic layer 33 is provided on a hollow metal core 32. The elastic layer 33 may be silicon rubber foam, silicon rubber, and/or fluorocarbon rubber. A thin release layer including PFA and/or PTFE may be provided on the elastic layer 33 to serve as a surface layer.

The fixing belt 21 rotates in accordance with rotation of the pressing roller 31. In FIG. 4, the pressing roller 31 is rotated by a drive source, and the drive force of the pressing roller 31 is transmitted to the fixing belt 21 at the fixing nip N to rotate the fixing belt 21.

The fixing belt 21 rotates between the nip formation member 26 and the pressing roller 31, which together sandwich the fixing belt 21 at the fixing nip N. The fixing belt 21 is further guided in its rotation by the heat conductive member 22 in areas other than the fixing nip N, thus preventing the fixing belt 21 from separating from the heat conductive member 22 beyond a certain distance.

Lubricant, such as silicone oil or fluorine grease, is applied to an interface between the fixing belt 21 and the heat conductive member 22. The surface roughness of the heat conductive member 22 is set to be not less than a particle diameter of the lubricant, facilitating retention of the lubricant on the surface of the heat conductive member 22.

Figure 5:
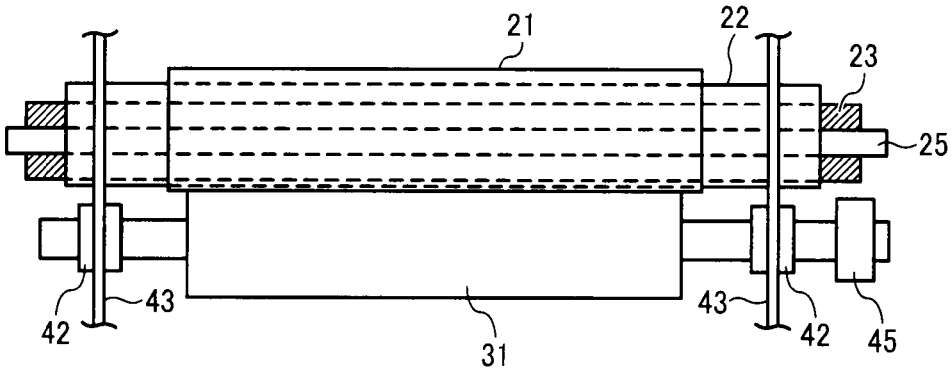
FIG. 5 is a cross-sectional elevation view illustrating a support structure of the fixing device in the image forming apparatus.

In the present exemplary embodiment, as illustrated in FIG. 5, the above-described components are provided at side plates 43 of the fixing device 20. Each of the side plates 43 is a rigid material that supports the components of the fixing device 20 and also serves as a reference point for positioning the components.

A gear 45 engaging a driving gear of the driving source is mounted on the pressing roller 31. Thus, the driving source rotates the pressing roller 31 clockwise, i.e., in a rotation direction R3 indicated by an arrow illustrated in FIG. 4.

Both ends of the pressing roller 31 in a width direction of the pressing roller 31, that is, in an axial direction of the pressing roller 31, are rotationally supported by the side plates 43 of the fixing device 20 via bearings 42, respectively. A heat source, such as a halogen heater, may be provided inside the pressing roller 31, but is not necessary.

When the elastic layer 33 of the pressing roller 31 includes a sponge material such as silicon rubber foam, the pressing roller 31 applies decreased pressure to the fixing belt 21 at the fixing nip N to decrease bending of the heat conductive member (supporting member) 22.

According to this exemplary embodiment, the loop diameter of the fixing belt 21 is equivalent to the diameter of the pressing roller 31. Alternatively, the loop diameter of the fixing belt 21 may be smaller than the diameter of the pressing roller 31. In this case, a curvature of the fixing belt 21 is smaller than a curvature of the pressing roller 31 at the fixing nip N, and therefore a recording medium P easily separates from the fixing belt 21 when the recording medium P is discharged from the fixing nip N.

Figure 6:
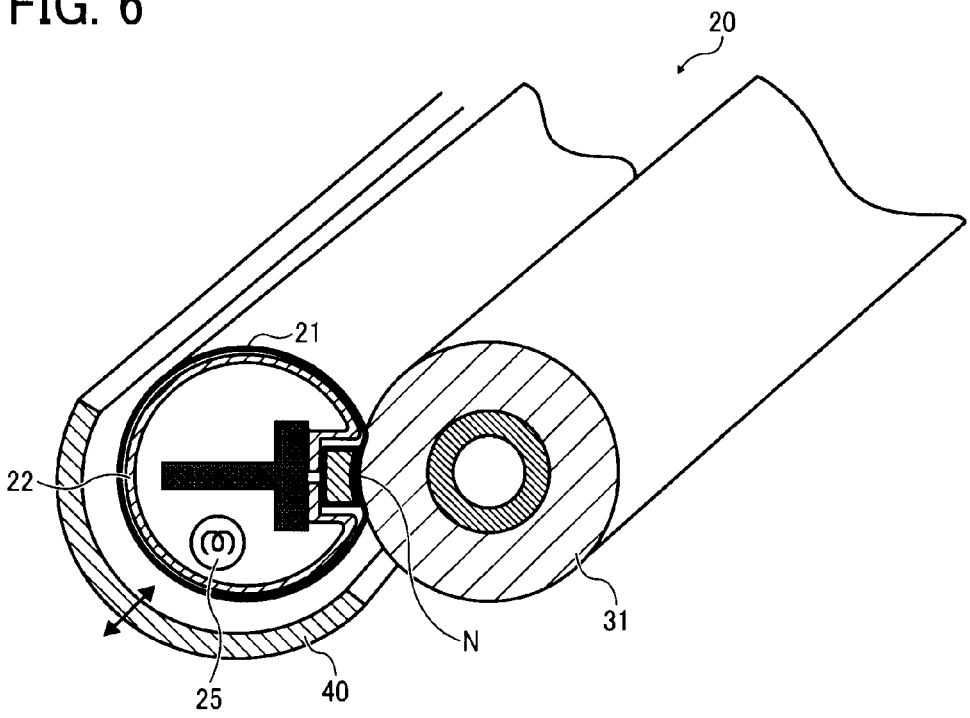
FIG. 6 is a perspective view illustrating a configuration and operation of the fixing device during fixing.
Figure 7:
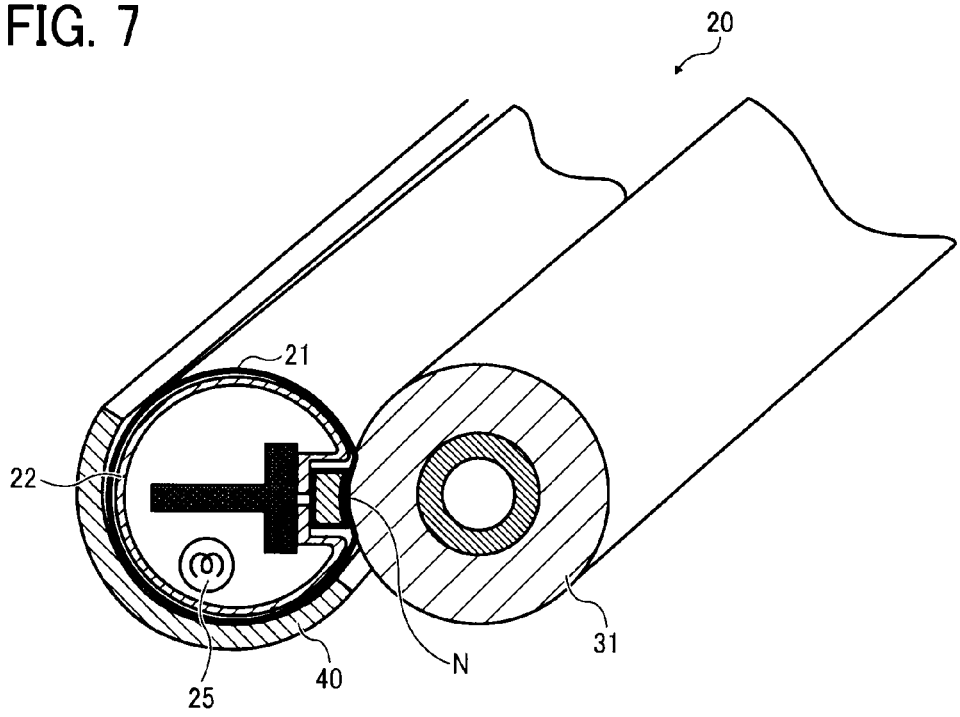
FIG. 7 is a perspective view illustrating a configuration and operation of the fixing device during cooling.

FIGS. 6 and 7 are schematic views illustrating a configuration and operation of the fixing device 20 according to the first exemplary embodiment.

In particular, the radiation member 40 shown in FIGS. 6 and 7 is preferably a highly heat-conductive material. In the present exemplary embodiment, the radiation member 40 is, for example, an aluminum-extruded material.

The radiation member 40 may be made of a plurality of radiation members but in the present exemplary embodiment, the radiation member 40 is made of a material having substantially the same length as a length of the fixing belt 21 in an axial direction of the radiation member 40.

The radiation member 40 is disposed facing a portion of the heat conductive member 22 that is heated by the halogen heater 25, has a relatively large clearance between the fixing belt 21 and the radiation member 40, and is distant from the fixing nip N.

FIG. 6 illustrates a state in which fixing is performed by activating the halogen heater 25 (during image formation of the image forming apparatus 1). The radiation member 40 moves back to a predetermined position with respect to the fixing belt 21 to prevent heat of the fixing belt 21 from wastefully conducting to the radiation member 40.

FIG. 7 illustrates a state in which the fixing belt 21 and the heat conductive member 22 are cooled when a user needs to do a certain operation, such as fixing a paper jam, after the fixing process.

Figure 8:
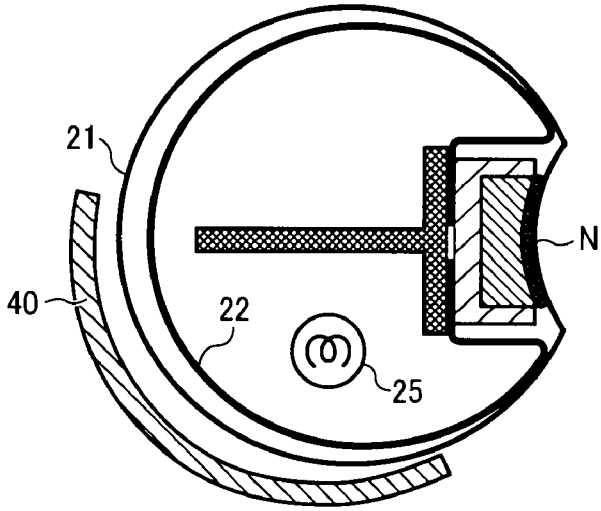
FIG. 8 is an enlarged view illustrating a portion of the fixing device during fixing.
Figure 9:
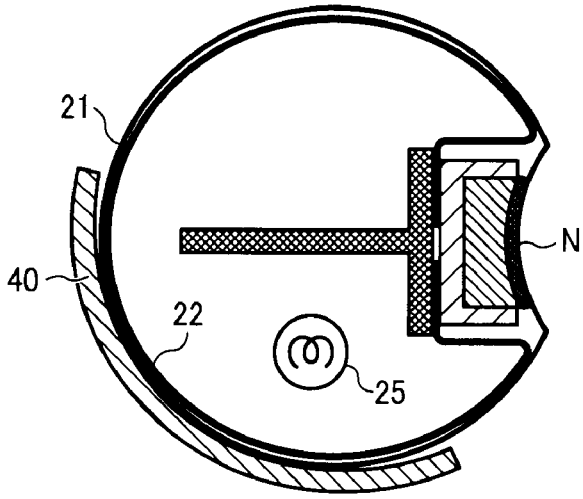
FIG. 9 is an enlarged view illustrating a portion of the fixing device during cooling.

FIGS. 8 and 9 are cross-sectional views depicting the state illustrated in FIGS. 6 and 7 in more detail.

As illustrated in FIG. 8, when the fixing belt 21 is not in rotation, the heat conductive member 22 is slightly separated away from the inner surface of the fixing belt 21. For such a configuration, a slight difference is provided between the diameters of the heat conductive member 22 and the fixing belt 21 so that the fixing belt 21 is rotatable.

When the fixing process is performed, the fixing belt 21 rotates in accordance with rotation of the pressing roller 31. At this time, the fixing belt 21 rotates in a rotation direction R2 indicated by an arrow illustrated in FIG. 4 and is dragged by the pressing roller 31 at a portion upstream from the fixing nip N, i.e., a portion heated by the halogen heater 25. Accordingly, the inner surface of the fixing belt 21 slides against the heat conductive member 22, allowing heat of the heat conductive member 22 to be conducted to the entire fixing belt 21.

At this time, the heat conductive member 22 is heated by the halogen heater 25 inside the heat conductive member 22, and as a result, the temperature of the heat conductive member 22 becomes higher than the temperature of the fixing belt 21. Thus, when the rotation of the fixing belt 21 is stopped after the heat conductive member 22 is heated as described above, as illustrated in FIG. 8, the fixing belt 21 is stopped with a clearance maintained between the heat conductive member 22 and the fixing belt 21.

In this state, the temperature of the heat conductive member 22, which is a pipe-shaped metal member, remains higher than the temperature of the fixing belt 21. Accordingly, while the outer circumference of the fixing belt 21 is cooled by outside air, the heat conductive member 22 is blocked from outside air, increasing the time for being cooled. Consequently, the difference in temperature between the fixing belt 21 and the heat conductive member 22 increases with time. For example, even when a reduced temperature of the fixing belt 21 is detected by a thermistor, the temperature of the heat conductive member 22 is not so reduced.

If a user finds a reduced temperature of the fixing belt 21 detected by the thermistor and tries to handle a paper jam or replace components, the user's touch may create a slight pressure against the fixing belt 21, causing the fixing belt 21 and the heat conductive member 22 to contact each other. At that moment, heat of the heat conductive member 22 still having a high temperature might be conducted to the user's hand.

Alternatively, as illustrated in FIG. 8, even if the outer circumference of the fixing belt 21 is cooled by wind from, for example, a fan, the situation is the same as described above. Consequently, a clearance between the fixing belt 21 and the heat conductive member 22 prevents heat of the heat conductive member 22 from being conducted to the fixing belt 21, increasing the time for cooling the heat conductive member 22.

Hence, in the first exemplary embodiment, as illustrated in FIG. 9, the radiation member 40 presses against the outer circumference of the fixing belt 21, thereby contacting the outer circumferential face of the heat conductive member 22 with the inner circumferential face of the fixing belt 21. Thus, heat of the heat conductive member 22 is radiated via the fixing belt 21, reliably cooling the fixing belt 21.

The radiation member 40 is detachably pressed against the fixing belt 21 by an actuator, such as a solenoid device. In an ordinary operation, such as a fixing process, as illustrated in FIGS. 6 and 8, the radiation member 40 is separated from the fixing belt 21, allowing the fixing device 20 to perform the fixing process.

However, when the image forming apparatus 1 is stopped and the fixing belt 21 is cooled, as illustrated in FIGS. 7 and 9 the radiation member 40 is pressed against the fixing belt 21 according to a predetermined sequence of image formation.

For example, before cooling, the radiation member 40 is 20 to 30 degrees C. while the fixing belt 21 heated is 150 to 160 degrees C. Accordingly, pressing the radiation member 40 against the fixing belt 21 causes the fixing belt 21 to be cooled. Preferably, the radiation member 40 is made of a material having excellent heat conductivity, allowing smooth cooling.

The pressure of the radiation member 40 against the fixing belt 21 may be generated by an elastic member, such as a spring, thereby preventing uneven pressure from being applied to the fixing belt 21. The radiation member 40 may be provided with a cooling fan or other cooling member to cool the radiation member 40.

Figure 10:
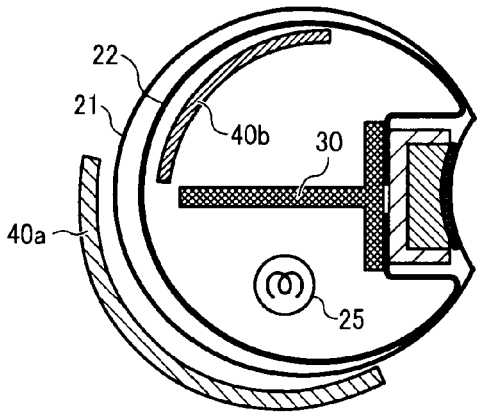
FIG. 10 is an enlarged view illustrating a configuration and operation of a fixing device according to a second exemplary embodiment during fixing.
Figure 11:
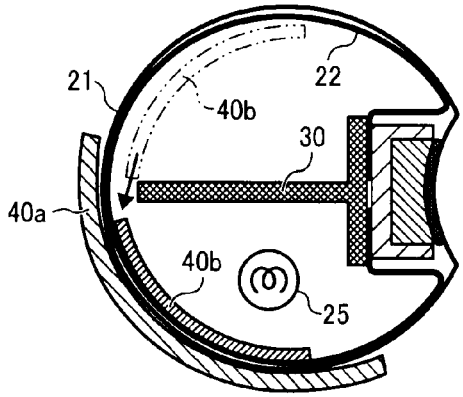
FIG. 11 is an enlarged view illustrating a configuration and operation of the fixing device according to the second exemplary embodiment during cooling.
Figure 12:
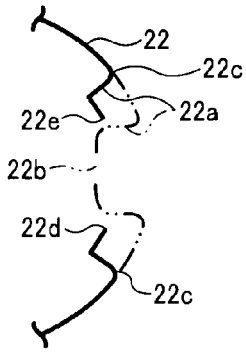
FIG. 12 is a schematic view illustrating a heat conductive (supporting) member.

FIGS. 10 and 11 are cross-sectional elevation views illustrating a configuration and operation of the fixing device 20 according to a second exemplary embodiment. In the following description, the same reference characters are allocated to members corresponding to those described above and redundant descriptions thereof are omitted below.

Basically, the fixing device 20 according to the second exemplary embodiment has a configuration similar to the configuration of the fixing device 20 according to the first exemplary embodiment. The difference between them is that, in the second exemplary embodiment, an external radiation member 40*a* having the same function as that of the radiation member 40 in the first exemplary embodiment is disposed along the outer circumference of the fixing belt 21 and an internal radiation member 40*b* is disposed along the inner circumference of the heat conductive member 22 so as to be movable within the heat conductive member 22.

As illustrated in FIG. 10, during execution of the fixing process (e.g., heating process), the internal radiation member 40*b* disposed inside the substantially-pipe-shaped heat conductive member 22 retreats to a position at which the holding member 30 is positioned between the internal radiation member 40*b* and the halogen heater 25 so that the internal radiation member 40*b* is not directly heated by the halogen heater 25.

Such a configuration prevents the internal radiation member 40*b* from being heated in the fixing process. If the internal radiation member 40*b* is heated to a high temperature and contacts the inner surface of the heat conductive member 22, the heat conductive member 22 may be cooled or radiated by the internal radiation member 40*b*.

Hence, in the present exemplary embodiment, by preventing the internal radiation member 40*b* from being heated, contacting the internal radiation member 40*b* with the heat conductive member 22 can produce an excellent cooling effect.

As illustrated in FIG. 11, when components heated are cooled after the fixing process and image formation, the internal radiation member 40*b* is rotated by an actuator, such as a stepping motor, and moves to the inner surface of the heat conductive member 22 to contact the heat conductive member 22. Meanwhile, the external radiation member 40*a* moves to contact the outer circumferential face of the fixing belt 21.

For such a configuration, even if the heat conductive member 22 is a thin pipe-shaped metal member and elastically deformed, the external radiation member 40*a* and the internal radiation member 40*b* press against the fixing belt 21 and the heat conductive member 22, respectively, allowing the fixing belt 21 and the heat conductive member 22 to be reliably cooled in a uniform manner.

In the present exemplary embodiment, the heat conductive member 22 contacts or faces the inner circumferential surface of the fixing belt 21 to support or hold the fixing belt 21 to heat the fixing belt 21. The heat conductive member 22 may be manufactured by bending a thin metal plate into a pipe shape at relatively reduced manufacturing costs, enhancing heating efficiency for heating the fixing belt 21, shortening a warm-up time or a first print time, and suppressing faulty fixing which may occur when the fixing device 20 is driven at high speed.

In the heat conductive member 22, as illustrated in FIG. 4, if a lateral edge portion 22*b* remains open after the thin metal plate is bent into the pipe shape, the inherent spring-back of the thin metal plate might enlarge the opening of the lateral edge portion 22*b*. Consequently, the heat conductive member 22 might not contact or press against the fixing belt 21 with uniform pressure.

Hence, at least a part of the lateral edge portion 22*b* in a width direction, that is, an axial direction, of the heat conductive member 22 may be jointed to prevent the spring-back of the heat conductive member 22 from enlarging the opening of the lateral edge portion 22*b*. For example, an upstream edge 22*d* may be combined with a downstream edge 22*e* by welding.

In the heat conductive member 22 illustrated in FIG. 4, the recessed portion 22*a* is provided to accommodate the nip formation member 26. If corner portions 22*c* and nearby portions of the heat conductive member 22 in the recessed portion 22*a* press against the pressing roller 31 via the fixing belt 21, pressure applied by the pressing roller 31 may deform the heat conductive member 22. Accordingly, the heat conductive member 22 may not contact or press against the fixing belt 21 with uniform pressure.

Hence, according to the above-described exemplary embodiments, the heat conductive member 22 including the corner portions 22*c* does not press against the pressing roller 31 via the fixing belt 21. For example, the corner portions 22*c* are provided at positions separated from the fixing nip N so that the corner portions 22*c* are separated from the pressing roller 31.

As described above, according to any of the above-described exemplary embodiments, during cooling, the radiation members 40, 40*a*, and 40*b* contact the fixing belt 21 and the heat conductive member 22. Thus, the fixing belt 21 and the heat conductive member 22 are radiated by the radiation members 40, 40*a*, and 40*b*, thereby allowing reliable and effective cooling of heated members heated in the fixing device 20. Such a configuration prevents uneven temperature at the fixing nip N in the subsequent operation, allowing excellent fixing. Further, when a user approaches or contacts the fixing section for handling a paper jam or replacing components, the above-described configuration provides safety against burns or other trouble due to heat of the fixing section.

According to the above-described exemplary embodiments, the fixing device 20 employs the pressing roller 31 as a pressing member. Alternatively, a pressing belt or a pressing pad may be used as the pressing member to provide effects equivalent to the above-described effects provided by the fixing device 20 including the pressing roller 31.

According to the above-described exemplary embodiments, the fixing belt 21 having a multi-layered structure is used as a fixing member. Alternatively, an endless fixing film including polyimide resin, polyamide resin, fluorocarbon resin, and/or thin metal may be used as a fixing member to provide effects equivalent to the above-described effects provided by the fixing device 20 including the fixing belt 21.

Further, the image forming apparatus 1 including the fixing device 20 according to any one of the above-described exemplary embodiments performs excellent and stable fixing to form a high-quality image consistently and prevents troubles due to heat in handling the fixing section, enhancing safety.

The fixing device described above is applicable to a fixing device that fixes images formed according to electrophotographic, electrostatic, or other type of image formation, and to a fixing section of an image forming apparatus, such as a copier, a printer, a facsimile machine, or a multifunctional periphery having at least two of the foregoing capabilities.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the scope of the present invention, and all such modifications are intended to be included within the scope of the present invention.

For example, elements and/or features of different exemplary embodiments may be combined with each other and/or substituted for each other within the scope of this disclosure and the appended claims.

What is claimed is:

1. A fixing device comprising:

an endless, flexible fixing member formed into a loop;

a heat conductive member disposed within the loop formed by the fixing member to conduct heat to the fixing member;

a heater disposed near the heat conductive member to heat the heat conductive member;

a pressing member rotatably pressed against the fixing member to form a fixing nip between the fixing member and the pressing member through which a recording medium is conveyed; and a radiation member detachably pressable against an outer circumference of the fixing member to contact the fixing member with the heat conductive member to cool the fixing member and the heat conductive member.

2. The fixing device according to claim 1, further comprising a second radiation member detachably pressable against an inner circumference of the heat conductive member to sandwich the fixing member and the heat conductive member between the radiation member and the second radiation member to cool the fixing member and the heat conductive member.

3. The fixing device according to claim 2, wherein, in a state in which the second radiation member is detached from the heat conductive member, the second radiation member is retreated to a position at which the second radiation member is not directly heated by the heater.

4. The fixing device according to claim 1, wherein the radiation member is disposed opposite a portion of the heat conductive member heated by the heater.

5. The fixing device according to claim 1, wherein the radiation member is made of a material of high heat conductivity.

6. The fixing device according to claim 1, wherein the fixing member is an endless flexible belt.

7. The fixing device according to claim 1, wherein the heat conductive member is a metal pipe.

8. An image forming apparatus comprising:

an image forming unit provided in the image forming apparatus to form an image on a recording medium; and a fixing device that fixes the image, formed by the image forming unit, on the recording medium, the fixing device comprising:

an endless, flexible fixing member formed into a loop;

a heat conductive member disposed within the loop formed by the fixing member to conduct heat to the fixing member;

a heater disposed near the heat conductive member to heat the heat conductive member;

a pressing member rotatably pressed against the fixing member to form a fixing nip between the fixing member and the pressing member through which the recording medium is conveyed; and a radiation member detachably pressable against an outer circumference of the fixing member to contact the fixing member with the heat conductive member to cool the fixing member and the heat conductive member.

* * * * *